US006679327B2

(12) United States Patent
Sloan et al.

(10) Patent No.: US 6,679,327 B2
(45) Date of Patent: Jan. 20, 2004

(54) INTERNAL ORIENTED PERFORATING SYSTEM AND METHOD

(75) Inventors: Mark L. Sloan, Bellville, TX (US); Erick R. Rantala, Washington, TX (US)

(73) Assignee: Baker Hughes, Inc., Houston, TX (US)

( * ) Notice: Subject to any disclaimer, the term of this patent is extended or adjusted under 35 U.S.C. 154(b) by 0 days.

(21) Appl. No.: 10/021,799

(22) Filed: Nov. 30, 2001

(65) Prior Publication Data

US 2003/0102162 A1 Jun. 5, 2003

(51) Int. Cl.[7] ..... E21B 43/119
(52) U.S. Cl. ..... 166/297; 166/55; 175/4.51
(58) Field of Search ..... 175/4.51, 2, 4.5; 166/255.2, 297, 55.1, 55, 255.1, 241.5, 241.6, 50

(56) References Cited

U.S. PATENT DOCUMENTS

| | | | | |
|---|---|---|---|---|
| 2,326,405 A | * | 8/1943 | Spencer | 166/55.1 |
| 3,049,185 A | * | 8/1962 | Herbold | 175/55 |
| 3,167,137 A | | 1/1965 | Humphrey | |
| 3,361,204 A | * | 1/1968 | Howard et al. | 166/297 |
| 3,730,282 A | | 5/1973 | Chapman | |
| 4,194,577 A | | 3/1980 | Vann | |
| 4,269,278 A | | 5/1981 | Vann | |
| 4,278,138 A | | 7/1981 | Rowley et al. | |
| 4,410,051 A | | 10/1983 | Daniel et al. | |
| 4,438,810 A | | 3/1984 | Wilkinson | |
| 4,523,649 A | | 6/1985 | Stout | |
| 4,586,847 A | | 5/1986 | Stanton | |
| 4,637,478 A | | 1/1987 | George | |
| 4,768,597 A | | 9/1988 | Lavigne et al. | |
| 4,830,120 A | | 5/1989 | Stout | |
| 4,844,161 A | | 7/1989 | Rankin et al. | |
| 5,010,964 A | | 4/1991 | Cornette | |
| 5,033,553 A | | 7/1991 | Miszewski et al. | |
| 5,040,619 A | | 8/1991 | Jordan et al. | |
| 5,103,912 A | | 4/1992 | Flint | |
| 5,107,927 A | | 4/1992 | Whiteley et al. | |
| 5,211,714 A | | 5/1993 | Jordan et al. | |
| 5,217,714 A | | 6/1993 | Imura et al. | |
| 5,273,121 A | | 12/1993 | Kitney et al. | |
| 5,484,029 A | | 1/1996 | Eddison | |
| 5,603,379 A | | 2/1997 | Henke et al. | |
| 5,964,294 A | | 10/1999 | Edwards et al. | |
| 2002/0185275 A1 | | 12/2002 | Yang et al. | |

FOREIGN PATENT DOCUMENTS

| | | |
|---|---|---|
| GB | 2 374 887 A | 10/2002 |

* cited by examiner

*Primary Examiner*—David Bagnell
*Assistant Examiner*—Matthew J. Smith
(74) *Attorney, Agent, or Firm*—Darryl M. Springs; Keith R. Derrington

(57) ABSTRACT

One embodiment of the present invention discloses a system and method for orienting perforating guns inside of slanted or deviated wellbores. The invention involves adding a weight inside of the guns to gravitate the gun to a specified orientation. The weight is situated on the outer circumference of the gun tube and within the inner diameter of the gun body. The invention is capable of orienting the gun in any radial position without affecting the shot performance of any of the shaped charges.

24 Claims, 2 Drawing Sheets

INTERNAL ORIENTED PERFORATING SYSTEM AND METHOD

BACKGROUND OF THE INVENTION

1. Field of the Invention

The invention relates generally to the field of oil and gas well services. More specifically, the present invention relates to an apparatus that orients a tool into a desired position while the tool is in a deviated wellbore.

2. Description of Related Art

When downhole tools, including perforating guns, are used in slanted or deviated wellbores it is often important that the tool be in a specific radial orientation. For example, orienting perforating guns in deviated wells enables the well operator to aim the shaped charges of the perforating gun at specific radial locations along the circumference of the wellbore. This is desired because the potential oil and gas producing zones of each specific well could exist at any radial position or region along the wellbore circumference. Based on the presence and location of these potential producing zones adjacent a deviated well, a well operator can discern a perforating gun orientation whose resulting perforations result in maximum hydrocarbon production.

Information relevant to attempts to orient downhole tools, including perforating guns, can be found in U.S. Pat. Nos. 4,410,051, 4,438,810, 5,040,619, 5,211,714, 4,637,478, 5,603,379, 5,964,294. However, each of these references suffers from one or more of the following disadvantages. Some of the devices described in these references position a perforating gun such that only downward perforations are possible, others obstruct the path of the some of the shaped charges located on the perforating gun, while others are attached to the exterior of the perforating gun which can make handling of the tool inside of a wellbore more cumbersome.

Daniel et al, U.S. Pat. No. 4,410,051 discloses a system for orienting a perforating gun to be used in wells having multiple tubing strings. The apparatus of Daniel et al. '051 consists of a plurality of subassemblies connected end to end. Situated in one of the subassemblies is an eccentric weight sub that contains a weight positioned asymmetric to the longitudinal axis of the housing. Connected to the bottom of the eccentric weight sub is the alignment joint sub which is used to align the bottom portion of the housing with outlets of the perforating gun. In Daniel et al. '051 the perforating gun section of the apparatus is disclosed as being below the eccentric weight sub. Wilkinson, U.S. Pat. No. 4,438,810 and Jordan et al., U.S. Pat. Nos. 5,040,619 and 5,211,714 also disclose the use of an eccentrically weighted sub attached to a perforating gun to rotate the perforating gun inside of a deviates wellbore.

George, U.S. Pat. No. 4,637,478 involves a gravity oriented perforating gun for use in slanted wells comprised of one or more segments or subs, where each sub contains a center of gravity movement means which is a window that is cut out of the sub wall to alter the sub symmetry. Because it is asymmetric, the sub will rotate until the heavier portion of the sub circumference is below the lighter portion of the sub circumference.

Henke et al., U.S. Pat. No. 5,603,379, involves an apparatus for connecting and orienting perforating guns in a deviated well bore. The orientation aspect of the device consists of a fin longitudinally connected to the body of the perforating gun that positions the gun off center in the casing so that gravity will position the gun body at the bottom of the casing. Because of the positioning aspect of Henke '379, the perforations are generally directed into a downward trajectory. Vann, U.S. Pat. Nos. 4,194,577 and 4,269,278 also disclose a perforating gun including longitudinal disposed fins on the gun outer circumference which act to direct the perforating charges in a downward pattern.

Edwards et al., U.S. Pat. No. 5,964,294, discloses a downhole tool for use in a deviated well constructed to rotate in response to a moment applied at its axis. The tool includes ballast chambers filled with a flowable ballast material to produce a gravitational force for rotating the tool. The ballast chambers are formed on the inner diameter of the loading tube assembly. The flowable ballast material consists of a high density metal such as tungsten or depleted uranium. Alternative embodiments include a multiple segmented tool where each tool has offset centers to produce rotation of the tool.

Therefore, there exists a need for a system that orients perforating guns in deviated wellbores where the shaped charges of the perforation gun can be directed in any radial orientation, a system that cooperates with a perforating gun having any shot pattern without affecting the shot pattern, and a system that is integral within the perforating gun.

BRIEF SUMMARY OF THE INVENTION

One embodiment of the present invention discloses a system and method for orienting downhole tools, including perforating guns, into a specified orientation, while the tool is inside of a deviated or slanted wellbore. The tool comprises a perforating gun having a substantially cylindrical gun body with an inner and an outer diameter. Disposed within the gun body is a gun tube also with an inner and an outer diameter. The gun tube contains at least one shaped charge. Attached to the outer surface of the gun tube is a weight. Each weight has apertures formed therethrough that are aligned with each shaped charge so that the shot performance of each shaped charge is not affected by the attached weight during detonation. The attached weight can be equal to or less than the length of the gun tube.

A method of aligning a perforating gun in a deviated wellbore comprises adapting a weight for attachment to the outer surface of a gun tube having one or more shaped charges. Radial locations along the weight are identified that coincide with the location of each shaped charge. Apertures through the weight are formed at each radial location. The weight is attached to the outer surface of gun tube such that the apertures are coaxially aligned with each shaped charge. The gun tube is placed into the gun body of a perforating gun, and the perforating gun containing the gun tube is inserted into the deviated section of a wellbore. When the rotation of the gun body caused by the Earth's gravitational force upon the eccentric weight has ceased, the shaped charges are ready to be detonated.

The method also envisions receiving coordinates where perforations are desired within the wellbore. The weight is then strategically situated on the gun body such that rotation of the gun body caused by the Earth's gravitational force upon the weight orients the gun body so the shaped charges are aimed at the coordinates.

DETAILED DESCRIPTION OF THE INVENTION

Figure 1:
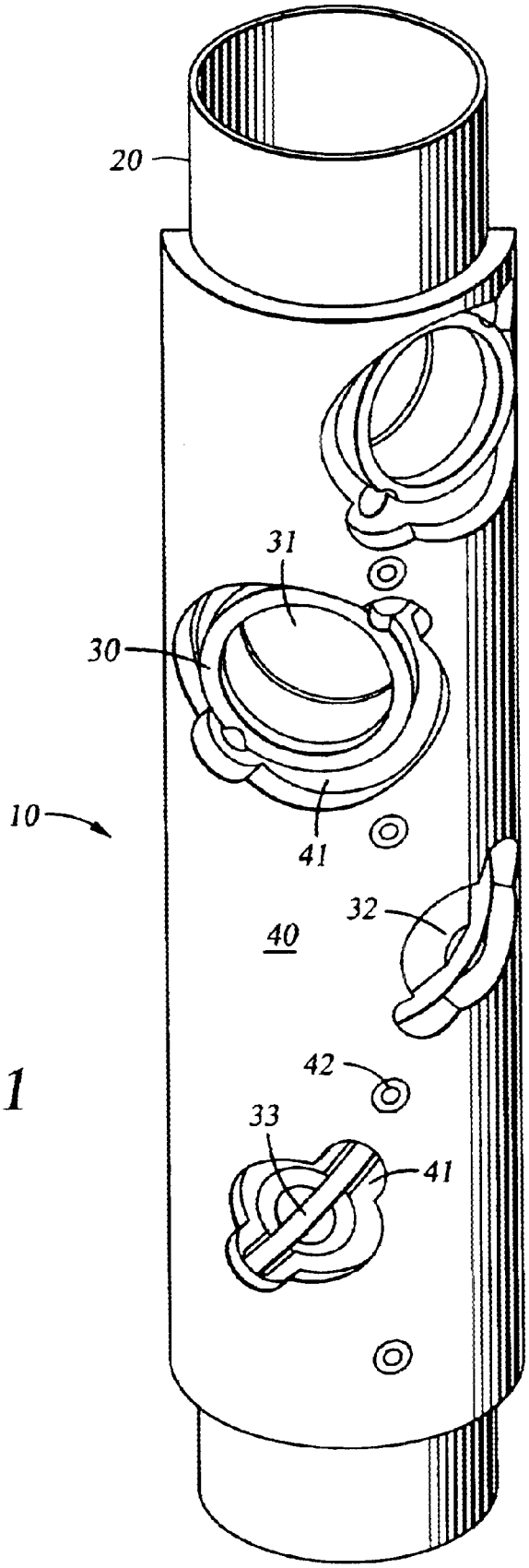
FIG. 1 illustrates a perspective view of a gun tube and eccentrically loaded weight of the Internal Oriented Perforating System.

With reference to the drawing herein, an internal oriented perforating system according to one embodiment of the present invention is shown in FIG. 1. The perspective view of FIG. 1 illustrates a gun tube 20 for use in a perforating system that incorporates one or more shaped charges 30 situated within the gun tube 20. The gun tube 20 is suitable for use in perforating subterranean wells, it is appreciated that one reasonably skilled in the art can produce a gun tube having shaped charges with ordinary effort and without undue experimentation. As is well known in the art, the gun tube 20 is a generally cylindrical elongated body with a range of lengths and diameters. While the length of the gun tube 20 of the present invention ranges from 4 feet to 28 feet, the advantages of the present invention can be enjoyed with a gun tube 20 of any length. The preferred diameters of the gun tube 20 are 2¾" and 2", however gun tubes of any diameter can be practiced as a part of this invention.

The perforating system of the present invention involves the gun tube 20 disposed within a gun body 21, the gun body 21 having a slightly longer length than the gun tube 20 located therein. Often times individual perforating guns are connected end to end to create a perforating gun assembly. Because perforation operations can involve perforating a section of wellbore of less than 10 feet to over 10,000 feet, the length of the perforating gun assembly will vary accordingly. To accommodate these situations, and as is well known, the perforating gun of the present invention can comprise a single gun tube 20 with a gun body 21, or multiple sections of the gun tube 20 and gun body 21. A swiveling connection (not shown) is used to connect multiple perforating guns into the perforating gun assembly. It is important that the connections allow the gun body 21 to rotate freely with respect to the connection and other gun bodies included in the perforating assembly.

Figure 2:
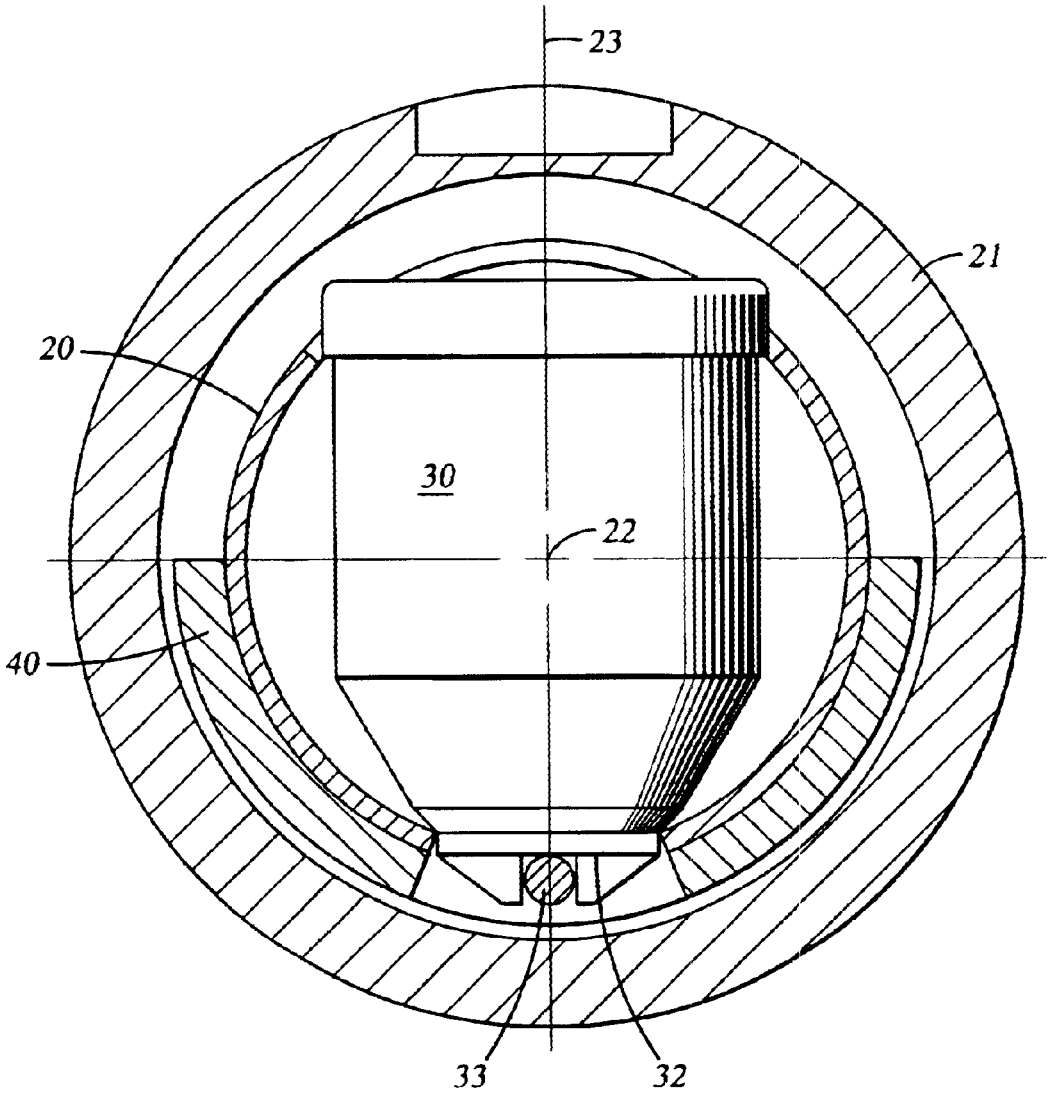
FIG. 2 depicts a cross-sectional view of the Internal Oriented Perforating System.

Attached to the outer circumference of the gun tube 20 is a weight 40 that produces an eccentric loading about the axis of the gun tube 20. While it is preferred that the weight 40 be secured to the gun tube 20 by fasteners 42, such as rivets, bolts, pins, tabs, or screws, other attachments could also include welding. The weight 40, as can be seen in FIG. 2, is generally semi-circular in cross section and includes apertures 41 formed at various locations along its body. The apertures 41 should be formed to be aligned with openings on the gun tube 20 where the shaped charge openings 31 and the shaped charge back 32 are located. While the weight 40 can be formed from any material, the material should have a high density and be machinable. As such, the preferred materials include carbon steel, depleted uranium, tungsten, steel alloys, copper alloys, stainless steel, and lead.

As can be seen from the figures, the shaped charge back 32 and the detonation cord 33 can extend past the outer circumference of the gun tube 20. To accommodate for these protrusions, the apertures 41 proximate to the shaped charge back 32 are created to tailor the weight 40 for a better fit onto the gun tube 20, while the apertures 41 proximate to the shaped charge openings 31 act to prevent the weight 40 from obstructing the discharge perforating jet produced by detonation of the shaped charges 30.

As seen in FIG. 2, the weight 40 attaches along a portion of the circumference of the gun tube 20 which produces an asymmetric structure. As is well known, when the perforating gun is in a generally horizontal position and the center of gravity of the weight 40 is directly below the gun tube center 22, the gravitational forces acting on the weight 40 on both sides of the gun tube centerline 23 are equal. When the gravitational forces about the gun tube centerline 23 are equal, gravity cannot cause rotation of the gun tube 20. However, when the center of gravity of the weight 40 is not directly below the gun tube center 22, the gravitational forces about the gun tube centerline 23 are not equal. The resulting imbalance will urge the weight 40 downward until the center of gravity of the weight 40 is directly below the gun tube center 22, i.e. or until the gravitational forces applied to the weight 40 on either side of the gun tube center 22 are equal. When this occurs the weight 40 is at its "low point."

Attaching the weight 40 to the gun tube 20 outer circumference, instead of some other location along the gun tube 20 radius, maximizes the gravitational moment arm experienced by the eccentrically weighted gun tube 20. Maximizing the moment arm produces a gun tube 20 more responsive to eccentrically applied gravitational forces. A gun tube 20 being more responsive to eccentrically applied gravitational forces will rotate quicker when these forces are applied. Additionally, a more responsive gun tube 20 is more likely to rotate until the weight 40 is in the low point without prematurely stopping and leaving the center of gravity of the weight 40 at a point higher than the low point. For reasons to be discussed below, it is important that the weight 40 be in the low point before the shaped charges 30 of the perforating gun are detonated.

In operation, one or more perforating guns of the present invention are assembled and inserted into a well that is to be perforated. Inserting the present invention into a wellbore can be done with a conventional wireline, in conjunction with a tractor sub, or can be tubing conveyed. When the perforating gun reaches a deviated or slanted portion of the well, the gravitational forces will act upon the eccentric weight 40 until the weight 40 is in the low position. Prior to assembly the wellbore technical personnel evaluate how the shaped charges 30 should be aimed based on potential producing zones adjacent the wellbore. The gun tube 20 orientation during detonation is dependent upon how the shaped charges should be aimed during the perforation sequence. Once the desired orientation of the gun tube 20 during detonation is finalized, it can then be determined where the weight 40 should be attached such that its eccentrically loaded mass can rotate the gun tube 20 into the desired orientation. Before the weight 40 is attached to the gun tube 20 apertures 41 are formed through the weight 40 so that the weight 40 will not cover the shaped charge opening 31 or the shaped charge back 32.

As the perforating gun is put into position for detonating the shaped charges, it will be cycled up and down inside of the wellbore to provide some mechanical force impulses to the gun tube 20. These impulses can shake the gun tube 20 and further ensure that the weight 40 has rotated into a low position. Cycling the perforation gun may be more important in instances where the deviated section of the wellbore exceeds 15° to 20° from horizontal, or if some foreign matter has become stuck between the gun tube 20 and the gun body 21, thereby retarding rotation of the gun tube 20 inside of the gun body 21. After completing the cycling process, the well operator positions the perforation gun to the depth inside of the wellbore where perforations are to be made. When the perforation gun is at the proper depth, the shaped charges 30 will be detonated thereby perforating the wellbore.

Alternative embodiments of eccentrically loading a perforating gun include introducing a semi-cylindrical gun tube that is asymmetric about its longitudinal axis. The asymmetry of the gun tube in and of itself eccentrically weights the perforating gun so that when non-vertical the perforating gun will rotate in response to gravitational pulls on the eccentric loading. Another alternative embodiment involves creating longitudinal recesses along sections of the gun tube 21 and adding metal rods or bars into those recesses. The presence of the metal rods or bars will produce an asymmetry that also can rotate the perforating gun. However, the recesses should be located in the same hemispherical section of the gun tube 21 to produce an eccentrically loaded situation. A yet additional alternative embodiment exists where asymmetry of the gun body 20 is developed by securing the gun tube 21 inside of the gun body 20 at or proximate to the inner circumference gun body 20 and not coaxial within the gun body 20.

The present invention described herein, therefore, is well adapted to carry out the objects and attain the ends and advantages mentioned, as well as others inherent therein. While a presently preferred embodiment of the invention has been given for purposes of disclosure, numerous changes in the details of procedures for accomplishing the desired results. Such as the utilization of non-metallic materials in the construction of the weight 40. Additionally, the device and method described herein is suitable for use in any type of well, such as a water well, and is not restricted to use in hydrocarbon producing wells. These and other similar modifications will readily suggest themselves to those skilled in the art, and are intended to be encompassed within the spirit of the present invention disclosed herein and the scope of the appended claims.

What is claimed is:

1. A perforating gun for use in a well comprising:

at least one substantially cylindrical gun body rotatable about its longitudinal axis having an inner and an outer circumference;

a substantially cylindrical gun tube disposed within said gun body, said gun tube having an inner and an outer circumference and containing at least one shaped charge; and at least one weight disposed on the outer surface of said gun tube that eccentrically loads said perforating gun with respect to its longitudinal axis, each said weight having apertures formed therethrough aligned with each said shaped charge.

2. The perforating gun of claim 1, said weight being disposed along the entire length of said gun tube.

3. The perforating gun of claim 1, said weight being disposed along a portion of said gun tube.

4. The perforating gun of claim 1, said apertures being positioned coaxial about each shaped charge without affecting the performance of the shaped charges.

5. The perforating gun of claim 1, where said weight has sufficient mass so the eccentric loading of said weight is capable of rotating said perforating gun about its longitudinal axis in response to gravitational forces applied to said weight.

6. The perforating gun of claim 1, where said weight is located between inner circumference of said gun body and the outer circumference of said gun tube.

7. A perforating gun comprising:

a multiplicity of substantially cylindrical gun bodies rotatable about their longitudinal axis each said gun body having an inner and an outer circumference;

each said gun body having at least one substantially cylindrical gun tube connectively disposed within said gun body, each said gun tube having an inner and an outer circumference and containing at least one shaped charge; and at least one weight disposed on the outer surface of each said gun tube that eccentrically loads said perforating gun with respect to its longitudinal axis, each said weight having apertures formed therethrough aligned with each said shaped charge.

8. The perforating gun of claim 7, said weight being disposed along the entire length of said gun tube.

9. The perforating gun of claim 7, said weight being disposed along a portion of said gun tube.

10. The perforating gun of claim 7, said apertures being positioned coaxial about each shaped charge without affecting the performance of the shaped charges.

11. The perforating gun of claim 7, where said weight has sufficient mass so the eccentric loading is capable of rotating said perforating gun about its longitudinal axis in response to gravitational forces applied to said weight.

12. The perforating gun of claim 7, further comprising swivel connectors attaching said gun bodies end to end.

13. The perforating gun of claim 7, where each said weight is disposed between the inner circumference of each said gun body and the outer circumference of each said gun tube.

14. A method of aligning a perforating gun in a deviated wellbore comprising the steps of:

adapting a semi-cylindrical eccentric weight for attachment to a gun tube having one or more shaped charges;

identifying radial locations along said eccentric weight that coincide with the location of each said shaped charge;

forming apertures through said eccentric weight at each said radial location;

securing said eccentric weight to the outer surface of said gun tube such that said apertures are coaxially aligned with each shaped charge;

placing said gun tube into a gun body of a perforating gun, and inserting the perforating gun containing said gun tube into a deviated section of a wellbore;

waiting until the rotation of said gun body caused by the Earth's gravitational force upon said eccentric weight has ceased; and detonating each of said one or more shaped charges.

15. The method of claim 14 further comprising selecting locations within a deviated wellbore where perforations are to be located.

16. The method of claim 14 further comprising positioning said eccentric weight onto a strategically situated spot on the gun tube such that rotation of the gun body caused by the Earth's gravitational force upon said eccentric weight orients the gun body so that the shaped charges are aimed at the perforation locations.

17. The method of claim 14 further comprising ensuring free rotation of said gun tube having an eccentric weight attached thereto inside of said gun body.

18. The method of claim 14 further comprising forming said eccentric weight to have a length equal to the length of said gun tube.

19. The method of claim 14 further comprising forming said eccentric weight to have a length less than the length of the gun tube.

20. The method of claim 14 further comprising forming said apertures to ensure that the performance of each of the shaped charges is not affected.

21. A perforating gun for use in a well comprising:

at least one substantially cylindrical gun body rotatable about its longitudinal axis having an inner and an outer circumference; and a substantially cylindrical gun tube disposed within said gun body, said gun tube having an inner and an outer circumference and containing at least one shaped charge, said gun tube producing an asymmetric mass loading condition about the longitudinal axis of said perforating gun capable of rotating said perforating gun about its longitudinal axis in response to gravitational forces acting upon said perforating gun.

22. The perforating gun of claim 21 wherein said gun tube is semi-cylindrical.

23. The perforating gun of claim 21 where longitudinal recesses are formed along the outer circumference of said gun tube and said recesses contain longitudinal members having a density equal to or higher than the density of said gun tube.

24. The perforating gun of claim 21 where a portion of said gun tube outer circumference contacts a portion of said gun body inner circumference.

* * * * *